US009701040B2

(12) United States Patent
Myers et al.

(10) Patent No.: US 9,701,040 B2
(45) Date of Patent: Jul. 11, 2017

(54) APPARATUS FOR DISTRESSING MATERIAL

(71) Applicant: AFI Licensing LLC, Lancaster, PA (US)

(72) Inventors: Matthew S Myers, Lititz, PA (US); Brian W Beakler, York, PA (US)

(73) Assignee: AFI Licensing LLC, Lancaster, PA (US)

( * ) Notice: Subject to any disclaimer, the term of this patent is extended or adjusted under 35 U.S.C. 154(b) by 824 days.

(21) Appl. No.: 14/176,299

(22) Filed: Feb. 10, 2014

(65) Prior Publication Data

US 2014/0224093 A1 Aug. 14, 2014

Related U.S. Application Data

(60) Provisional application No. 61/763,143, filed on Feb. 11, 2013.

(51) Int. Cl.
*B27M 1/00* (2006.01)
*B27G 17/04* (2006.01)

(52) U.S. Cl.
CPC ..... *B27M 1/003* (2013.01); *B27G 17/04* (2013.01); *Y10T 83/02* (2015.04)

(58) Field of Classification Search
CPC ..... B27M 3/00; B27M 3/08; B27M 1/003; B27G 17/02; B27G 17/025; B27G 17/04; B27G 17/06; B27C 1/02; B27C 1/002; B27C 1/10; B27C 1/14; B27D 5/00; B27D 5/006; B26D 3/02; B26D 3/06; B26D 3/08
See application file for complete search history.

(56) References Cited

U.S. PATENT DOCUMENTS

| | | | |
|---|---|---|---|
| 327,312 | A | 9/1885 | Reinhard et al. |
| 1,609,889 | A | 12/1926 | Sherman |
| 2,032,806 | A | 3/1936 | Loken |

(Continued)

FOREIGN PATENT DOCUMENTS

| | | |
|---|---|---|
| CN | 2442803 Y | 8/2001 |
| DE | 46003 | 1/1889 |

(Continued)

OTHER PUBLICATIONS

Chinese Search Report for corresponding CN Application No. 2014100466410, filed Mar. 1, 2016. CN.

(Continued)

*Primary Examiner* — Matthew G Katcoff

(57) ABSTRACT

An apparatus and method for distressing material, such as a board. The apparatus may include a cutter head supporting a blade, a guide member, and a flattening device. The flattening device and the guide member are positioned proximate the cutter head and on opposite sides thereof. In response to the cutter head and the surface of the material being brought into cutting contact and moved relative to each other, a resulting portion of the surface of the material is distressed. The flattening device maintains the proper vertical position of the cutter head and blade relative to the material and a material support as the material is being brought into cutting contact with the cutter head. The guide member levels warped material boards thereby bringing the board into proper elevation and engagement with the blade for cutting or scraping a top surface of the board. The material may be wood.

22 Claims, 8 Drawing Sheets

(56) References Cited

U.S. PATENT DOCUMENTS

| | | | |
|---|---|---|---|
| 2,484,476 | A | 10/1949 | Teigland |
| 2,734,535 | A | 2/1956 | Neubauer |
| 2,829,686 | A | 4/1958 | Hecht |
| 2,846,801 | A | 8/1958 | Brown |
| 3,726,328 | A | 4/1973 | Luebs et al. |
| 3,791,427 | A | 2/1974 | Haynes |
| 3,957,095 | A | 5/1976 | Johnson |
| 5,779,845 | A | 7/1998 | Kiryanoff et al. |
| 7,784,506 | B2 | 8/2010 | Janzen |
| 8,051,886 | B2 | 11/2011 | Tappan et al. |
| 2002/0132050 | A1 | 9/2002 | Frame |
| 2005/0081391 | A1 | 4/2005 | Denker |
| 2008/0289723 | A1 | 11/2008 | Janzen |
| 2009/0223600 | A1 | 9/2009 | Tappan |
| 2010/0304089 | A1 | 12/2010 | Magnusson |
| 2011/0113721 | A1 | 5/2011 | Hak |
| 2011/0186180 | A1 | 8/2011 | Peronto et al. |
| 2011/0318993 | A1 | 12/2011 | Smith |

FOREIGN PATENT DOCUMENTS

| | | | |
|---|---|---|---|
| DE | 2260123 | | 7/1974 |
| DE | 0017594 | A1 | 10/1980 |
| DE | 2821666 | C2 | 12/1982 |
| DE | 19621973 | A1 | 12/1997 |
| DE | 102007046426 | A1 | 4/2009 |
| EP | 1398126 | A1 | 3/2004 |
| FR | 1292286 | | 5/1962 |
| WO | 2008140447 | | 11/2008 |

OTHER PUBLICATIONS

Extended European Search Report for corresponding EP Application No. 14154551.7, filed Feb. 10, 2014. EP.

Partial EP Search Report, dated Mar. 18, 2014, for corresponding EP Appl. No. 13197219.2, Filed Dec. 13, 2013.

APPARATUS FOR DISTRESSING MATERIAL

CROSS-REFERENCE TO RELATED APPLICATIONS

The present application claims the benefit of U.S. Provisional Patent Application Ser. No. 61/763,143 filed Feb. 11, 2013, which is incorporated herein by reference in its entirety.

FIELD OF THE INVENTION

The present invention relates generally to apparatus and methods for distressing a material, such as wood, and specifically to apparatus and methods for methods for distressing a material that maintains the position of a cutting head to reduce chatter and gouging.

BACKGROUND OF THE INVENTION

It has become fashionable to subject furniture and other objects/fixtures or surfaces of walls or flooring of a structure, such as a residence to a design style or technique sometimes referred to as distressing or antiquing. These design styles are intended to "age" the surface of the item or object treated to achieve a unique and/or rustic look. In one aspect of this design style, the surface of the item may be subjected to operations such as sanding, denting, and/or scraping. Typically these types of operations would be performed on furniture or other items, including walls or flooring that are composed of a cellulose-containing material, such as wood and composite board to produce a distressed surface.

Aspects of a distressed surface can include random irregularities formed in the surface of a material, such as variations relating to depth, width and length of the formed surface irregularity by a tool brought into contact with the material surface, as well as random locations along the surface of the material being scraped. In addition, imperfections are typically desirable, and can occur in response to variations, especially abrupt changes, in mechanical properties of a material having a surface to be distressed. Such changes or variations in mechanical properties could relate to density or hardness of the material. Examples include knots, burls and changes in grain direction, such as commonly associated with wood. The desirable appearance of a material surface variation such as a burl, for example, would typically exhibit discontinuities, sometimes referred to as "chattering", such as formed by a scraping tool in the material surface both prior to and subsequent to a scraping tool encountering the burl.

Known constructions of apparatus have been devised in an attempt to produce materials having the desired aspects associated with a distressed material surface. Such constructions have included sanding heads having discontinuities formed therein, molded heads that are placed in a pressurized contact with a material surface, as well as embossing drums or plates. However, all known apparatus have failed to reduce chatter and produce the desired features associated with a distressed material surface.

A device which can maintain the position of a cutting head relative to a cutting surface to reduce chatter, thereby producing the desired features associated with a distressed material surface in a material would be desirable in the art.

SUMMARY OF THE INVENTION

According to one embodiment, an apparatus for distressing a surface of a material includes a support configured for supporting a board of material, a cutter head supporting a blade, the cutter head having a first side and a second side, and a guide member positioned proximate the first side of the cutter head, the guide member configured and positioned to engage the board. The guide member is configured to compress and flatten the board when the board moves between the guide member and material support.

According to another embodiment, an apparatus for distressing a surface of a material includes a support configured for supporting a board of material, a cutter head supporting a blade, the cutter head having a first side and a second side, a guide member positioned proximate the first side of the cutter head, the guide member configured and positioned to engage the board, and a flattening device positioned proximate the second side of the cutter head, the flattening device configured and positioned to engage the board. The guide member is configured to compress and flatten the board when the board moves between the guide member and material support.

According to another embodiment, a method of distressing a board includes: supporting a first board on a support; moving the first board relative to a cutter head; engaging a top surface of the first board with a guide member; distressing the first board using the cutter head; engaging the top surface of the first board with a flattening device; supporting a second board on the support; moving the second board relative to the cutter head; distressing the second board; maintaining engagement of the top surface of the first board with the flattening device as the second board is moved proximate the cutter head; and preventing the cutter head from moving toward the support as the first board is moved from the cutter head and the second board is moved toward the cutter head.

According to an embodiment, an apparatus for distressing material is disclosed. The apparatus includes a cutter head, a flattening device, and a guide member. The flattening device and the guide member may be positioned proximate the cutter head. In response to the cutter head and the surface of the material being brought into cutting contact and moved relative to each other, a resulting portion of the surface of the material is distressed. A bottom surface of the flattening device is positioned a first distance from the material and a bottom surface of the guide member is positioned a second distance from the material. In one embodiment the first distance and the second distance are equal. In another embodiment, the first distance and the second distance are not equal.

According to a further embodiment, an apparatus for distressing material is disclosed. The apparatus includes a cutter head and a support for supporting a material having a surface and a longitudinal axis. A flattening device is positioned proximate the support and proximate the cutter head. The flattening device is angled with respect to the support and cooperates with the material as the material is moved from the cutter head or the cutter head is moved toward the material or a combination of both. A guide member is positioned proximate the support and proximate the cutter head. The guide member is positioned on the opposite side of the cutter head from the flattening device. The guide member is angled with respect to the support to provide a lead-in surface and control the depth of cut. The guide member cooperates with the material as the material is moved toward the cutter head or the cutter head is moved over the surface of the material or a combination of both. In response to the cutter head and the surface of the material being brought into cutting contact and moved relative to each other, a resulting portion of the surface of the material is distressed. The flattening device maintains the proper vertical position of the cutter head relative to the material and the support as the material in being brought into cutting contact with the cutter head.

According to yet another embodiment, a method of distressing a board is disclosed. The method includes: supporting a first board on a support member; moving a first board relative to a cutter head or moving the cutter head relative to the first board or a combination of both; distressing the first board; engaging a surface of the first board with a flattening device; supporting a second board on the support member; moving a second board relative to the cutter head or moving the cutter head relative to the second board or a combination of both; and distressing the second board. The flattening device remains in contact with the surface of the first board as the second board is moved proximate the cutter head, preventing the cutter head from moving toward the support member as the first board is moved from the cutter head and the second board is moved toward the cutter head.

According to yet another embodiment, an apparatus for distressing a surface of a material includes a cutter head, a guide member and a flattening device. The cutter head has a first side and an oppositely facing second side. The guide member is positioned proximate the first side of the cutter head. The flattening device is provided proximate the second side of the cutter head and has a surface which cooperates with ends of the material to prevent the ends from lifting after the material has passed the cutter head.

Other features and advantages of the present invention will be apparent from the following more detailed description of the preferred embodiment, taken in conjunction with the accompanying drawings which illustrate, by way of example, the principles of the invention.

BRIEF DESCRIPTION OF THE DRAWINGS

The features of some non-limiting examples will be described with reference to the following drawings, where like elements are labeled similarly, and in which.

Figure 1:
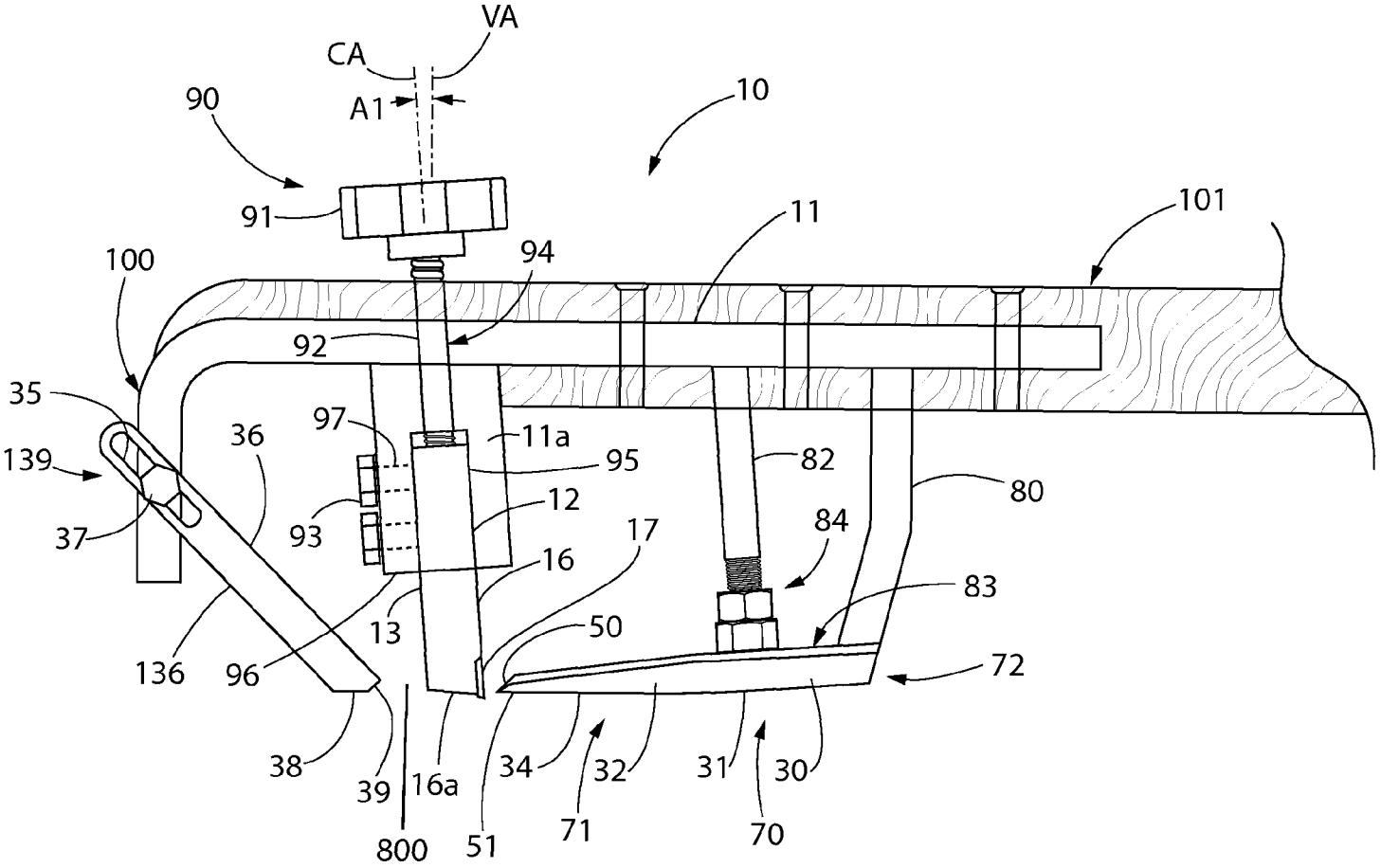
FIG. 1 is a schematic of an apparatus for distressing material in accordance with an embodiment of the present invention.

All drawings are schematic and not necessarily to scale.

DETAILED DESCRIPTION OF THE INVENTION

The description of illustrative embodiments according to principles of the present invention is intended to be read in connection with the accompanying drawings, which are to be considered part of the entire written description. In the description of embodiments of the invention disclosed herein, any reference to direction or orientation is merely intended for convenience of description and is not intended in any way to limit the scope of the present invention. Relative terms such as "lower," "upper," "horizontal," "vertical," "above," "below," "up," "down," "top" and "bottom" as well as derivative thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation unless explicitly indicated as such. Terms such as "attached," "affixed," "connected," "coupled," "interconnected," and similar refer to a relationship wherein structures are secured or attached to one another either directly or indirectly through intervening structures, as well as both movable or rigid attachments or relationships, unless expressly described otherwise. Moreover, the features and benefits of the invention are illustrated by reference to the preferred embodiments. Accordingly, the invention expressly should not be limited to such preferred embodiments illustrating some possible non-limiting combination of features that may exist alone or in other combinations of features; the scope of the invention being defined by the claims appended hereto.

Provided is a device for maintaining the position of a cutting head for distressing a surface of a work piece material such as by cutting, which is intended to include scraping in some embodiments. The device is configured to hold down end-lifted material or boards. The device additionally is configured to maintain the position of the cutting head relative to the surface of the material, by supporting the cutting head if it encounters a gap either in the surface of the material or between individual pieces of material. This advantageously results in an extended life cycle of the cutting blades of the cutting head and positions the cutting head to achieve an optimum cutting contact with the material surface. It is intended that the term cutting contact include scraping, i.e., that the blade is removing shavings and/or chips from the material surface. It is also intended that workpiece materials may include, but not be limited to, wood and other cellulose-containing materials, such as composite board.

For purposes of the disclosure, a distressed surface is intended to exhibit a number of characteristics or aspects. For example, a distressed surface or material surface having a distressed appearance or the like is intended to include random irregularities formed in the surface of a material, such as variations relating to depth, width and length of the formed surface irregularity, such as by a blade brought into contact with the material surface. In addition, a distressed surface is intended to include imperfections that may occur in response to variations, especially abrupt changes, in mechanical properties of a material having a surface to be distressed. Such changes or variations in mechanical properties could relate to density or hardness of the material. Examples include knots, burls and changes in grain direction, such as commonly associated with wood. With a distressed surface, the desirable appearance of a material surface variation such as a burl, for example, would typically exhibit discontinuities, sometimes referred to as "chattering", which can be formed by the blade of the apparatus. The discontinuities would be manifested in the material surface at locations both prior to and subsequent the blade encountering the burl.

As shown in FIG. 1, an apparatus or tool 10 of the present disclosure includes a cutter head 16 which may be supported by a cutter head support 11 having a distal end 100 and proximal end 101. The cutter head support 11, in one embodiment, may be an elongated structure that is supported in a substantially horizontal orientation. The distal end 100 may be a free end. Thus, in certain embodiments, the cutter head support 11 may extend in a cantilevered manner.

The cutter head 16 may have a vertically elongated body and includes a first side 12, a second side 13 that is opposite the first side 12, and a blade or blade 17. The blade 17 may be disposed on the first side 12 of the cutter head 16 in certain embodiments. Other mounting locations for the blade 17 may be used. The cuter blade 17 terminates in a distal cutting edge which as discussed below, is used to distress a surface of a material to be worked on, such as a wooden member, plank, composite board, or other material. The distal cutting edge of the blade 17 may be a concave edge, a convex edge, a linear edge, or combinations thereof.

Figure 7:
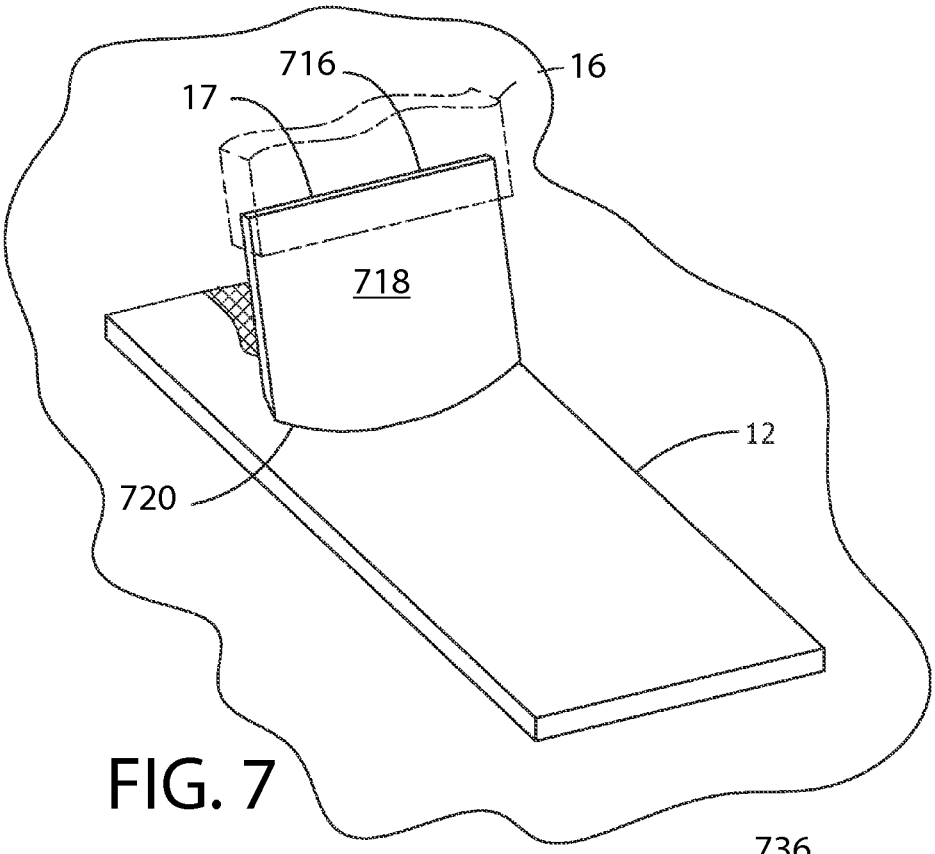
FIG. 7 is a perspective view of an embodiment of a blade of the apparatus of FIG. 1 positioned adjacent a material to be distressed.
Figure 8:
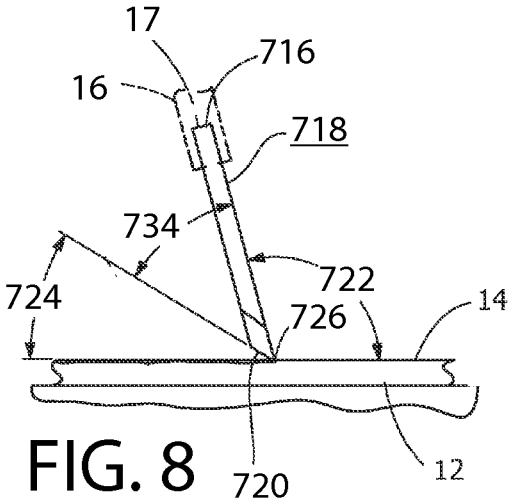
FIG. 8 is a side plan view of the blade of FIG. 7.
Figure 9:
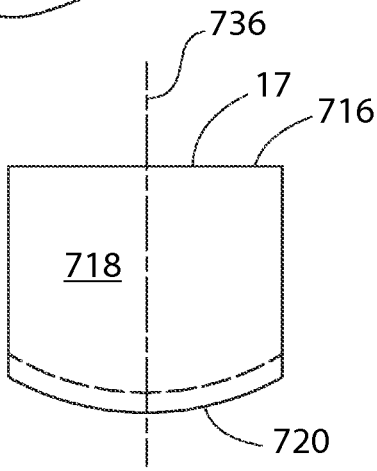
FIG. 9 is a front view.

Referring now to FIGS. 7-9 concurrently, the blade 17 may have a body 716 having a front surface 718 and a back cutting surface 720. In one embodiment, the blade 17 is constructed of a single, contiguous material, such as a carbide, a steel, such as M2 tool steel, or other suitable material that maintains an edge, even when subjected to impact, such as between the blade and the material surface. In another embodiment, blade 17 may be formed of several materials joined together, such as by welding, or by utilization of coatings, if desired. The blade 17 includes an acute blade angle 734 subtended between front surface 718 and back cutting surface 720, which surfaces intersect at a point or tip 726. In one embodiment, blade angle 734 is between about 66 degrees and about 78. In one embodiment, the curved back cutting surface 720 defines a profile of between about a 12 inch radius and about an 18 inch radius. In other embodiments, curved back cutting surface 720 can define any radius or non-radial (e.g., oval) curve falling within this range. In another embodiment, as shown in FIG. 9, the profile of curved back cutting surface 720 is symmetric about central axis 736, although in another embodiment, curved back cutting surface 720 contains no axis of symmetry. That is, the amount or degree of curvature of curved back cutting surface 720 can vary, if desired. This range of size of curved back cutting surface 720 encompasses different amounts of curved back cutting surface 720, similarly corresponding to an amount of penetration or depth of a surface of distressed material surface from a "pristine" surface of material 12 for a predetermined amount of force directed between blade 17 and surface of material 12.

The blade 17 includes an obtuse mount angle 722 subtended between front surface 718 and surface 14 of material 12 facing back cutting surface 720, which surfaces intersect at point or tip 726. In one embodiment, the blade angle 734 is between about 92 degrees and about 98 degrees. Mount angle 722 defines an angular position or orientation of the front surface 718 of blade 17 with respect to surface 14. The blade 17 includes an acute substrate clearance angle 724 subtended between back cutting surface 720 and surface 14 of material 12. In one embodiment, clearance angle 724 is between about 4 degrees and about 22 degrees. The substrate clearance angle 724 encompasses a range of angular separation between back cutting surface 720 and surface 14 of material 12 which has been shown to substantially prevent an accumulation of removed material from surface 14 between surface 14 and back cutting surface 720 sufficient to "clog" the space defining the angular separation.

Referring again to FIG. 1, the cutter head 16 may be movably disposed in a vertically elongated recess 95 formed in cutter head support 11, and in one embodiment in a downward extending protrusion 11 a of the cutter head support 11. Thus, the relative positioning between the cutter head 16 and the cutter head support 11 can be adjusted. For example, the cutter head 16 may be adjusted to protrude from the downward extending protrusion 11*a* different amounts. A bottom end 16*a* and adjacent lower portion of the cutter head 16 projects outwards from the recess 95 and below a bottom surface 96 of the cutter head support 11. In the exemplified embodiment, the bottom surface 96 is located on the downwardly extending protrusion 11*a*. The blade 17 may be mounted on the protruding portion of the cutter head 16 to engage the workpiece material 12, as further described herein.

As mentioned above, the cutter head 16 may be attached to the cutter head support 11 such that the vertical position and height is adjustable with respect to the support 11 and the material 12. In one non-limiting example, an adjustment mechanism 90 may be provided which includes a knob 91 and a partially or completely threaded shaft 92 affixed thereto that extends through a vertical bore 94 formed in the cutter head support 11. The bore 94 penetrates and communicates with the upper portion of the recess 95 formed in the cutter head support 11. The cutter head 16 may be threadably mounted at the top to a bottom end of the shaft 92 via threaded engagement. One or more fasteners, such as locking screws 93, may be disposed and rotatable in mating threaded bores 97 in the cutter head 16 that penetrate and communicate with the cutter head recess 95. In one embodiment, two screws 93 may be provided. The bores 97 are arranged perpendicular to the cutter head 16 so that the screws 93 are engageable with lateral sides of the cutter head 16 to fix the vertical position of the cutter head 16 with respect to the cutter head support 11 and workpiece material 12. When the screws 93 are loosened, the cutter head 16 is vertically adjustable in position by raising and lowering the knob 91. The invention is not limited to the foregoing adjustable arrangement; however, and the cutter head 16 may be attached to the cutter head support 11 in a fixed manner and vertical position.

Figure 2:
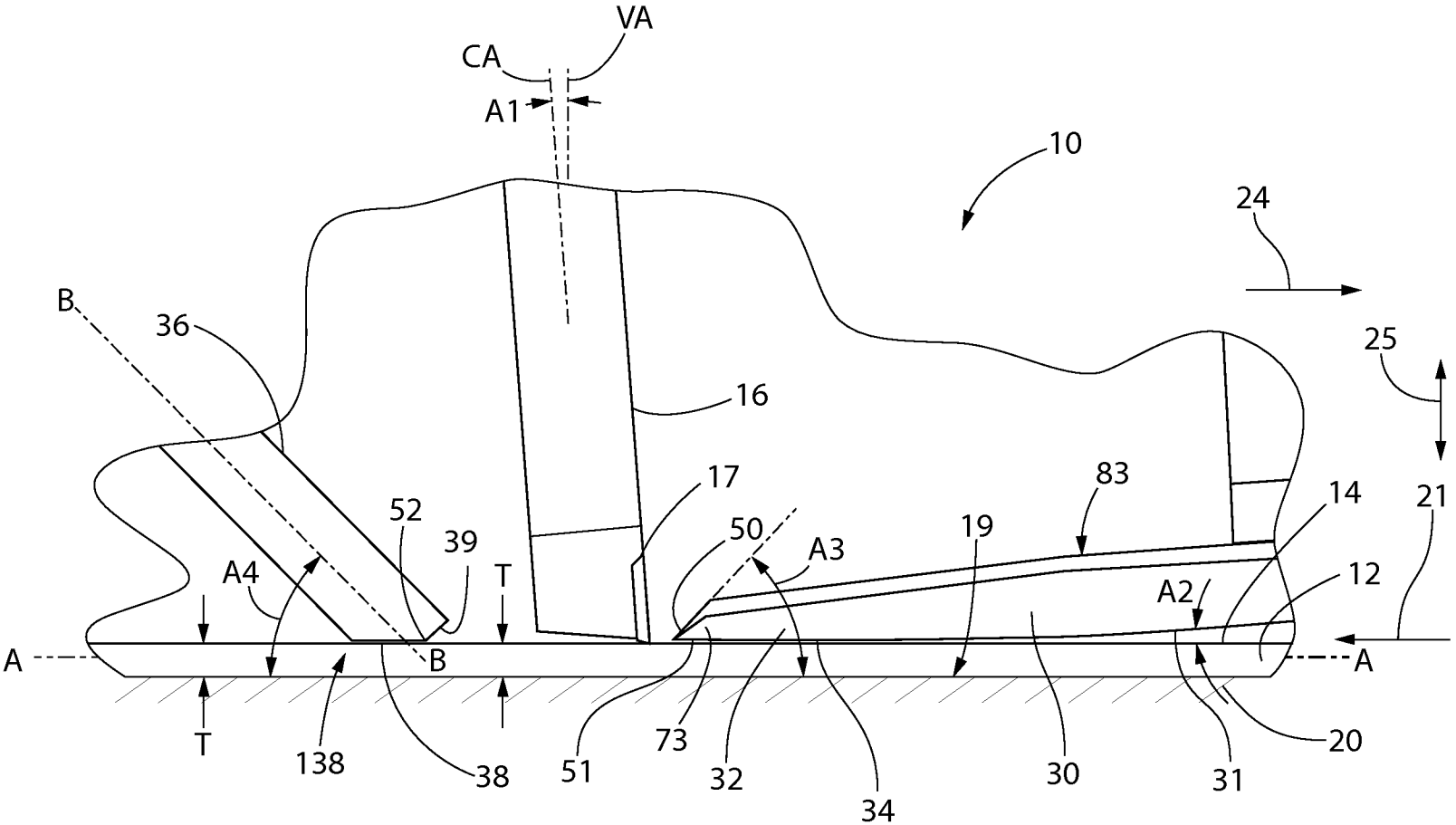
FIG. 2 is a schematic of the apparatus of FIG. 1 with a piece of material positioned proximate the cutting head.

Referring to FIGS. 1 and 2, the cutter head 16 extends along a cutter axis CA. In some embodiments, the cutter axis CA may be parallel to a reference vertical axis VA. In other embodiments, as illustrated, cutter axis CA may be angled or inclined with respect to vertical axis VA at an angle A1. Angle A1 may be between 0 degrees and 90 degrees in one non-limiting example. This angles or inclines the blade 17 with respect to the top working surface to achieve a desired cutting angle. The reference vertical axis VA, in the exemplified embodiment, is perpendicular to a top surface 19 of a material support 20. The reference vertical axis VA, in certain embodiments, may also be perpendicular to a top working surface 14 of a workpiece material 12.

Referring to FIG. 2, a workpiece material 12, such as a board used in flooring applications, defines a longitudinal axis A-A and includes a top working surface 14. The board may be formed of or comprise wood. The working surface 14 may be an exposed top surface which faces outward and is visible when installed on a building structure such as a floor, ceiling, wall, or other surface. The material 12 is supported by a material support 20 used to hold the material during the cutting or scraping process. In one embodiment, the material support 20 can convey or move the material 12 along a process line, such as by a motorized moving belt or other type material conveyor of known construction. The material 12 may therefore be movable with respect to the cutter head 16. In one embodiment, the material 12 is moved at least in a first material movement direction 21 which may be longitudinal along the axis A-A, as indicated in FIG. 2. In one embodiment, the longitudinal axis A-A may be a horizontal axis. In other possible embodiments, the material 12 may be moved in a lateral direction transverse to the longitudinal axis A-A. The invention is not so limited however, and the material 12 may be moved in other directions or may remain stationary while the cutter head 16 is moved to cut or scrape the working surface of the material 12. The surface 14 of the material 12 is intended to be distressed by the blade 17 of the cutter head 16. In use, the cutter head 16 and the working surface 14 of the material 12 are brought into cutting contact and at least one of the blade 17 or the material 12 is moved relative to the other. The movement causes at least a portion of the working surface 14 to have a distressed appearance or distressed surface. For purposes of the present disclosure, the term cutter head is also intended to include abrading contact devices which scrape the working surface 14 of the material 12.

The apparatus 10 may include a guide member 30 (also referred to herein as a positioning member or bar) which is positioned proximate the material support 20 (see, e.g. FIG. 2). Guide member 30 is spaced apart (vertically) from material support 20 so that the workpiece material 12 may be interspersed therebetween for mechanical distressing. Guide member 30 may further include a forward leading section 70 which first encounters the moving material 12 when moving in direction 21 with material support 20 and an adjoining rear trailing section 71. The forward leading section 70 may be obliquely or acutely angled (e.g., angle A2 as shown in FIG. 2) with respect to the material support 20 to provide an angled or inclined lead-in surface 31. This raises and vertically spaces the front end 72 above the top surface 14 of the material 12 to prevent binding of the guide member 30 on the material during processing and movement. In addition, the angled forward leading section 70 provides a lead-in surface for progressively engaging the material 20 (e.g. board) with the guide member 30 as the material moves between the guide member and support 20. As will be discussed in further detail below, the guide member 30 cooperates with the material 12 as the material 12 is moved toward the cutter head 16.

In one embodiment, guide member 30 is preferably mounted to cutter head support 11 on an opposite side of cutter head 16 than flattening device 36 such that the blade 17 is disposed between the guide member 30 and the flattening device 36. Accordingly, the cutter head 16 and blade 17 are vertically supported on opposite sides to maintain a relative elevation and vertical position with respect to material support 20 and material 12 thereon.

The guide member 30, specifically rear trailing section 71, may further define an end portion 32 which is positioned proximate the cutter head 16 and includes a bottom surface 34 which is angled such that the surface 34 is substantially parallel to a top surface 19 of the material support 20 and the top working surface 14 of the material 12. The end portion 32 is configured and operable to engage the top surface 19 of material 12 during the distressing operation for properly positioning the top surface in relation to the cutting blade 17 for cutting and/or scraping. The end portion 32 comprises a distal surface 50 which defined a rear end 73. The distal surface 50 and the surface 34 may meet at an apex 51. Surface 50 may be angled with respect to top surface 19 of material support 20 at an angle A3 between 0 and 90 degrees to assist with removing and dispersing wood chips or curls (i.e. shavings) removed from material 12 by cutting blade 17. In one non-limiting example, angle A3 may be about 50 degrees.

The bottom surface 34 of guide member 30 may be positioned at a first vertical distance d1 (FIG. 3*b*) from the top surface 14 of the material 12. In the exemplified embodiment, the bottom surface 34 of guide member 30 is also positioned the first vertical distance d1 from the cutting edge of the blade 17. Preferably the distance d1 is between about 0 inches to about 0.020 inches. In the illustrative embodiment shown, the distance d1 from the bottom surface 34 of the guide member 30 to the top surface 14 of the material 12 is about 0 inches wherein the bottom surface slidingly engages the material 12 as the material moves beneath the guide member. Bottom surface 34 may further be spaced apart from top surface 19 of material support 20 by a vertical distance D7 which is at least equal to the thickness T of material 12 (e.g. a board) or slightly larger. In some embodiments, distance D7 may be 0 inches to about approximately 3/16 inches larger than thickness T of material 12. The distance D7 functions to flatten a material 12 board when the board passes between the material support 20 and bottom surface 34 of guide member 30.

Figure 6:
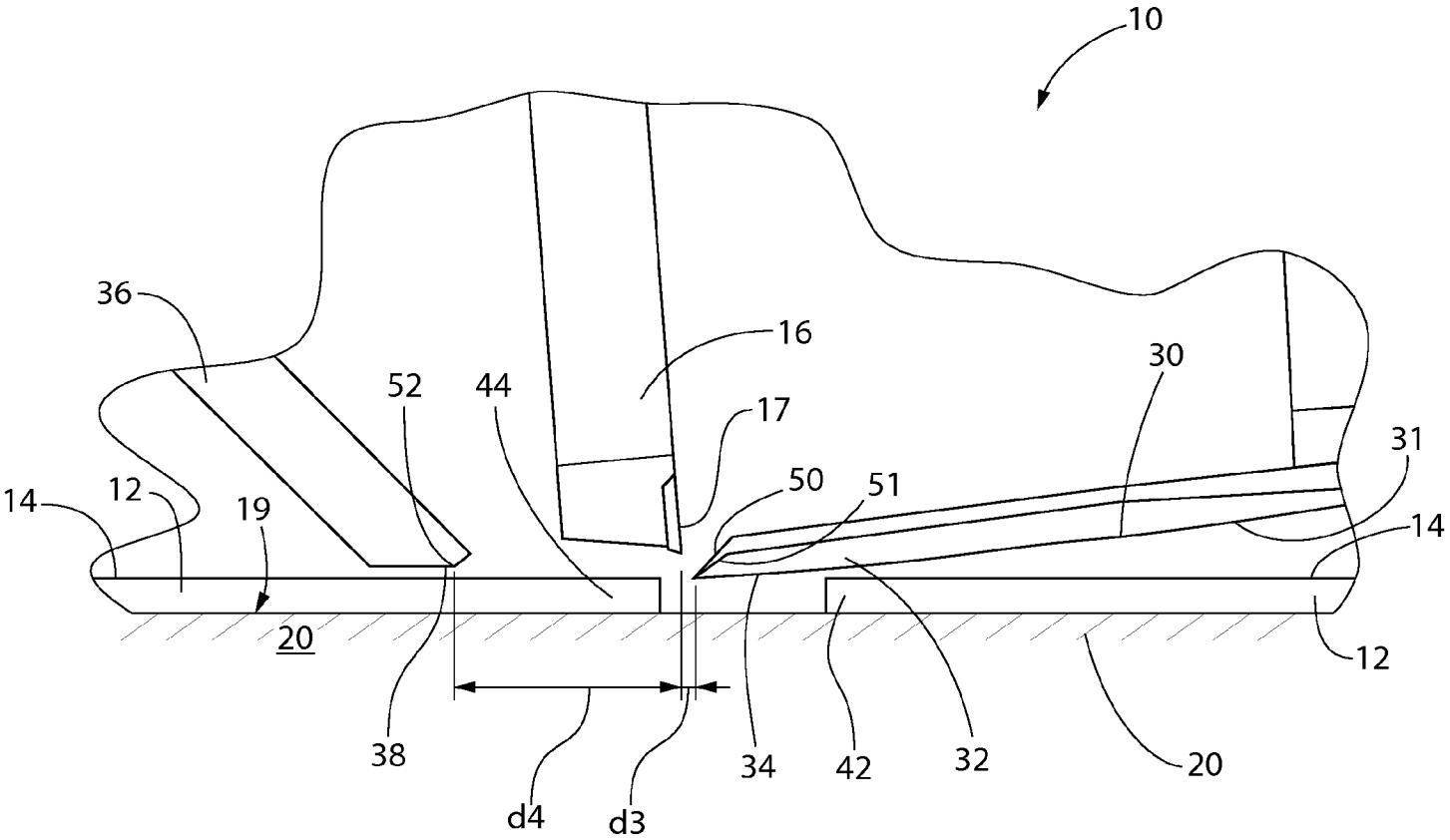
FIG. 6 is a schematic of the apparatus of FIG. 1 with several pieces of material positioned proximate the cutting head.

Referring to FIG. 6, the horizontal distance d3 between the apex 51 of the guide member 30 and the cutting surface of the blade 17 is between about and including 0.10 inches to about and including 0.25 inches in some embodiments. In the illustrative embodiment shown, the distance d3 is about 0.12 inches. The invention is not so limited however, and the distance between the apex of the guide member 30 and the cutting surface of the blade 17 can vary depending on the spacing between materials to be distressed and the size of irregularities in the material to be distressed. The distance d3 is dimensioned to allow cut debris removed from the surface 14 of material 12 by blade 17 (i.e. shavings) to be transported away from the surface and the blade 17 through the opening formed by d3.

In one embodiment, guide member 30 may be supported and suspended above workpiece material 12 by cutter head support 11 as shown in FIG. 1. The cutter head support 11 may be detachably mounted to the cutter head support 11 by a first vertical support member 82 which is removably mounted to guide member 30 at a bottom end of the support member. In one configuration, support member 82 may be generally cylindrical in shape and comprise a threaded fastener assembly 84 for detachable mounting of guide member 30. The support member 82 may be attached to guide member 30 at a location between ends 72 and 73. Support member 82 may be attached to or integrally formed with the cutter head support linear the proximal end 101 of the cutter head support.

The cutter head support 11 may further include a forward guide post 80 which may not be coupled directly to guide member 30. Instead, guide post 80 may be configured and arranged to contact and engage the top surface 83 of guide member 30 for restricting the upward movement of the front end 72 of the guide member when the workpiece material 12 engages the guide member. Guide post 80 may have any suitable configuration. In one arrangement, guide post 80 engages the front section 70 of the guide member 30 at a location proximate to the front end 72 of the guide member. Cutter head support 11 may be further mounted on and supported by a mounting structure 85 formed of a suitable material, including wood, metal, polymer, or other material. Cutter head support 11 may be formed of a suitable material, and in one embodiment may be metal such as aluminum or steel.

The apparatus 10 further comprises a nosebar or flattening device 36 positioned proximate to but vertically spaced apart from the material support 20. Flattening device 36 may have an elongated body and is mounted to distal end 100 of cutter head support 11. The flattening device 36 is positioned proximate the second side 13 of the cutter head 16. In the embodiment shown, the flattening device 36 is positioned on the opposite side of the cutter head 16 from the guide member 30.

As shown in FIGS. 2 through 6, a lower distal end 138 of the flattening device 36 is configured for slideably engaging top surface 14 of material 12. The distal end 138 of the flattening device 36 may be angled at an angle A4 with respect to the material support 20, thereby allowing the flattening device 36 to cooperate with the material 12 as the material is moved from and past the cutter head 16, as will be more fully described. The flattening device 36 holds the workpiece material 12 down against the material support 20 behind the blade 17 to ensure that the material 12 remains in contact with the material support 20 for proper axial alignment and contact between the cutting blade 17 and material. The flattening device 36 supports both the distal end 100 of cutter head support 11 and blade 17 for maintaining proper cutting elevation and position of the blade with respect to the top surface 14 of the material 12 to be distressed.

In one illustrative embodiment, the longitudinal centerline axis B-B of the flattening device 36 may be angled at an acute or oblique angle A4 between 0 and 90 degrees, and in one non-limiting example approximately 40 degrees to the top surface 19 of the material support 20, although other angles may be used. A bottom surface 38 of the distal end 138 of flattening device 36 is angled such that the surface 38 is essentially parallel to the top surface of the material support 20. The flattening device 36 further comprises an angled or chamfered guide surface 39 and an apex 52. The chamfered lower surface 39 is at an acute angle relative to the top surface 19 of the support 20 and faces the blade 17. The flattening device 36 further comprises an angled section 136 having a bottom surface disposed at an acute angle with respect to the top surface 19 of the support 20. The bottom surface of the angled section 136 of the flattening device 36 may provide a lead-in surface for progressively engaging the board 20 with the flattening device when the board 20 is fed to the blade 17 in the direction 24 (FIG. 2). The bottom surface of the angled section 136 of the flattening device 36 faces away from the cutting blade 17.

The bottom surface 38 of the flattening device which contacts the top surface 14 of the material 12 is positioned at a vertical distance d2 (see also FIG. 3*a*) from the top surface 14 of the material 12. In the exemplified embodiment, the bottom surface 38 of the flattening device is also positioned at the vertical distance d2 from the cutting edge of the blade 17. Preferably, the distance d2 is between about 0.020 inches and about 0.125 inches. In the illustrative embodiment shown, the distance d2 from the bottom surface 38 of the flattening device 36 to the surface 14 of the material 12 is about 0.060 inches. Bottom surface 38 may further be spaced apart from top surface 19 of material support 20 by a vertical distance D6 which is at least equal to the thickness T of material 12 (e.g. a board) or slightly larger. In some embodiments, distance D6 may be 0 inches to about approximately 3/16 inches larger than thickness T of material 12. The distance D6 functions to flatten a material 12 board when the board passes between the material support 20 and bottom surface 34 of guide member 30.

The horizontal distance d4 (see FIG. 6) between the apex 52 of the flattening device 36 and the forward cutting surface of the blade 17 is between about 0 inches to about 2 inches. In the illustrative embodiment shown, the distance d4 may be about 1.2 inches. The invention is not so limited however, and the distance between the apex 52 of the flattening device 36 and the cutting surface of the blade 17 can vary depending on the spacing between materials to be distressed and the size of irregularities in the material to be distressed.

As best shown in FIG. 1, the flattening device 36 may be slideably and rotationally attached to the cutter head support 11 of the tool 10 near the upper proximal end 139 of the device. In the embodiment shown, the flattening device 36 may include an adjustment feature comprised of an elongated slot 35 through which a fastener such as bolt 37 or the like extends. Bolt 37 passes through distal end 100 of cutter head support 11. As the bolt 37 is loosened via a threaded nut or other device on the back side of the cutter head support 11 (not shown), the flattening device 36 may be adjusted in vertical height and angle relative to the cutter head support, material 12, and further relative to the cutting blade 17, thereby allowing the distances d2 and d4 to be adjusted accordingly. The flattening device 36 is disposed at an oblique angle A4 with respect to the material support 20 as shown in FIG. 2. This angle A4 may be adjusted using the foregoing position adjustment feature.

As further shown in FIG. 2, the apparatus 10 is movable in at least one direction relative to the material support 20. For example, the apparatus 10 and/or the cutter head 16 is movable in a vertical direction 25 that raises or lowers cutter head 16 vertically relative to surface 14 of material 12. The apparatus 10 and/or cutter head 16 may also be moved in other directions, sometimes referred to as degrees of freedom. For example, apparatus 10 and/or cutter head 16 may be movable in a second direction that is coincident or substantially coincident or substantially parallel with the top surface 19 of the material support 20 in a longitudinal direction 21 and/or lateral direction transverse to the longitudinal direction and longitudinal axis A-A. Accordingly, numerous directions and combinations of movement of apparatus 10 are possible.

In one embodiment, movement of the cutter head 16 in the direction which is coincident or substantially coincident with material movement direction 21 is performed at least in combination with movement of cutter head 16 at least substantially in an opposite direction 24 in order to perform a manual scraping movement or a movement which mimics or otherwise resembles such a manual scraping movement. A manually performed scraping movement is generally understood to correspond to a scraping movement stroke performed by an individual utilizing a scraping tool to scrape a surface of a material. In such movement, one arm of an individual holding a scraping tool would be substantially extended, placing the blade of a scraping tool in contact with a surface of a material that is to be distressed. Simultaneously, a hand of the other arm would be placed substantially over the blade of the scraping tool, with the arm associated with the hand applying a force directing the blade of the scraping tool into contact with the surface of the material to be distressed. While maintaining the contacting force, the individual would subsequently pull or draw the scraping tool toward himself/herself until the elbow of the individual's arm holding the scraping tool is sufficiently near the individual's torso, wherein the individual would discontinue both of the pulling/drawing movement of the scraping tool, as well as the contacting force. That is, the initial scraping stroke is completed, and subsequently repeated until the desired "scraped" appearance is achieved. In one embodiment, the apparatus 10 may be hand-held and used manually, but the invention is not so limited. In other embodiments, the apparatus may remain stationary and affixed to a fixture while the material 12 may be moved relative to the apparatus such as by a moving material support 20 as described herein.

Figure 3:
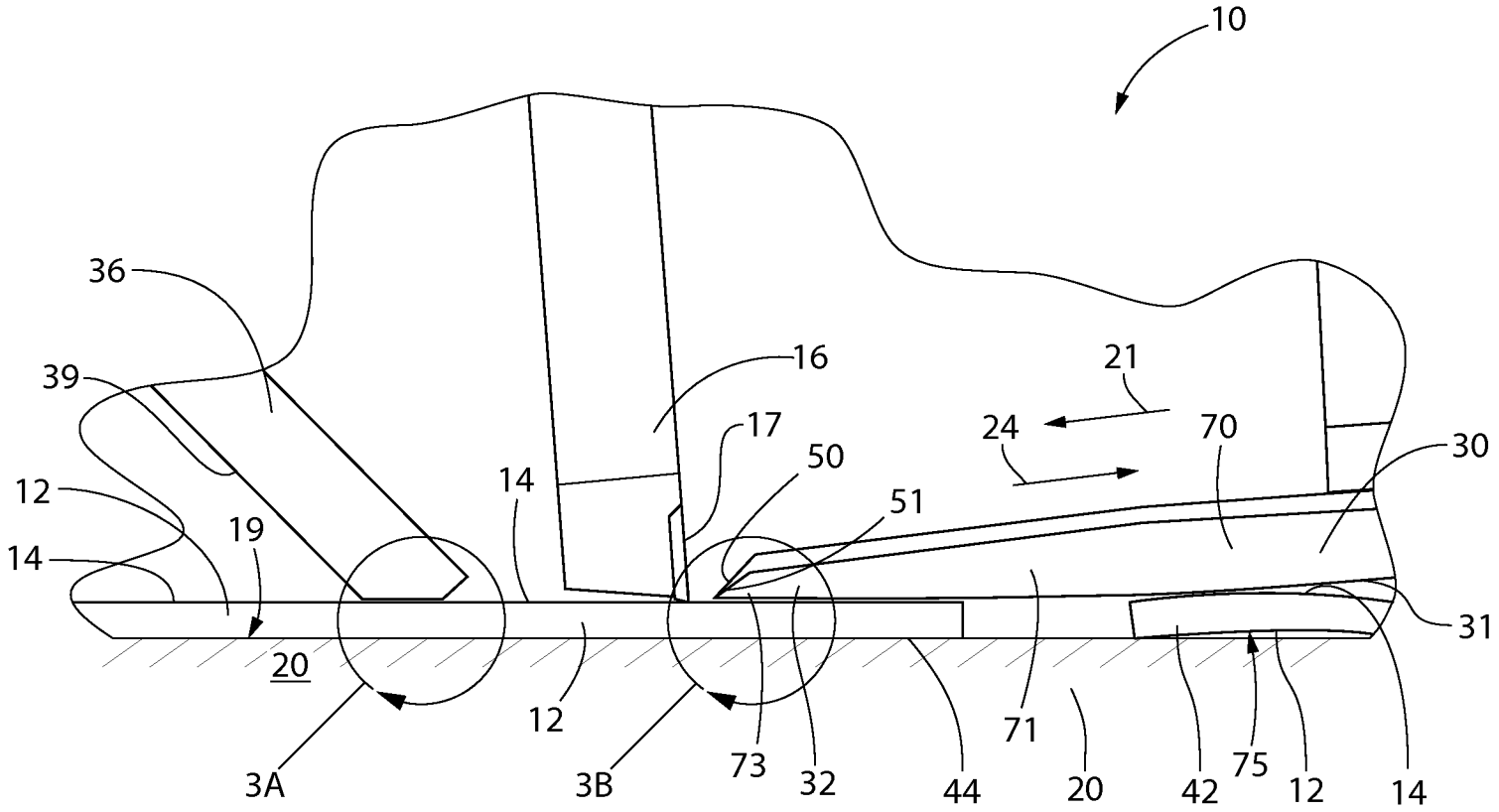
FIG. 3 is a schematic of the apparatus of FIG. 1 with several pieces of material positioned proximate the cutting head.

Referring to FIGS. 2 and 3, in use, the material 12 is moved relative to the apparatus 10 in the direction of arrow 21. Direction 21 may therefore be a first direction of travel of the material 12 and material support 20. Alternatively, the apparatus 10 is moved relative to the material 12 in the opposite second direction of arrow 24, or both the material 12 and the apparatus 10 are moved relative to each other in the opposing directions indicated by respective arrows 21 and 24. As this occurs, the leading edge 42 of the material 12 is moved into the proximity of guide member 30. Continued movement of the material 12 relative to the apparatus 10 causes the leading edge 42 to be moved under the guide member 30. If the leading edge 42 is warped or lifted from the material support 20, the lead-in surface 31 will engage the leading edge 42. Continued movement then causes the leading edge 42 of material 12 to move along the lead-in surface, causing the leading edge 42 to be moved downward into or proximate to the material support 20. This creates flattening action on the material 12 which is compressed between the bottom surface 34 on rear trailing section 71 of guide member 30 and top surface 19 of material support 20 to ensure proper positioning of the material 12 for cutting/scraping.

Figure 3A:
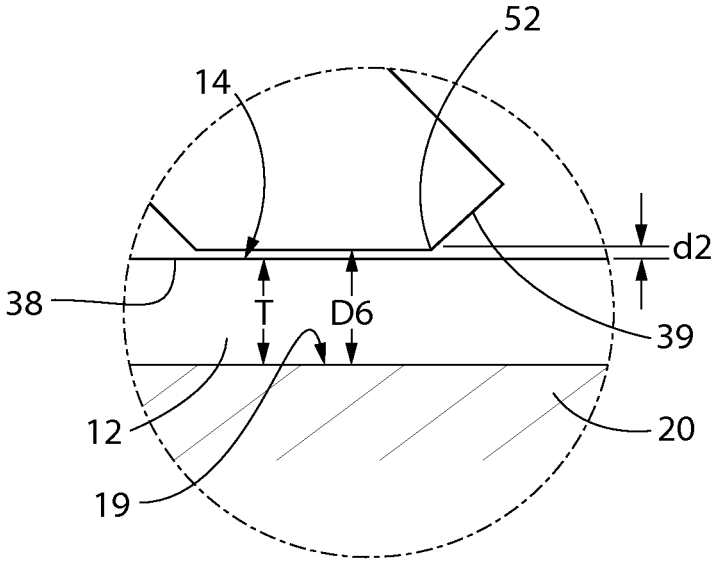
FIG. 3*a* is an enlarged view of the area labeled 3*a* in FIG. 3.
Figure 3B:
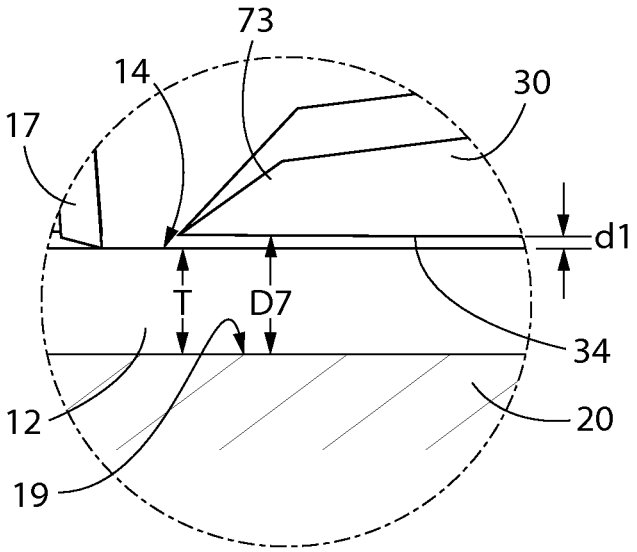
FIG. 3*b* is an enlarged view of the area labeled 3*b* in FIG. 3.
Figure 4:
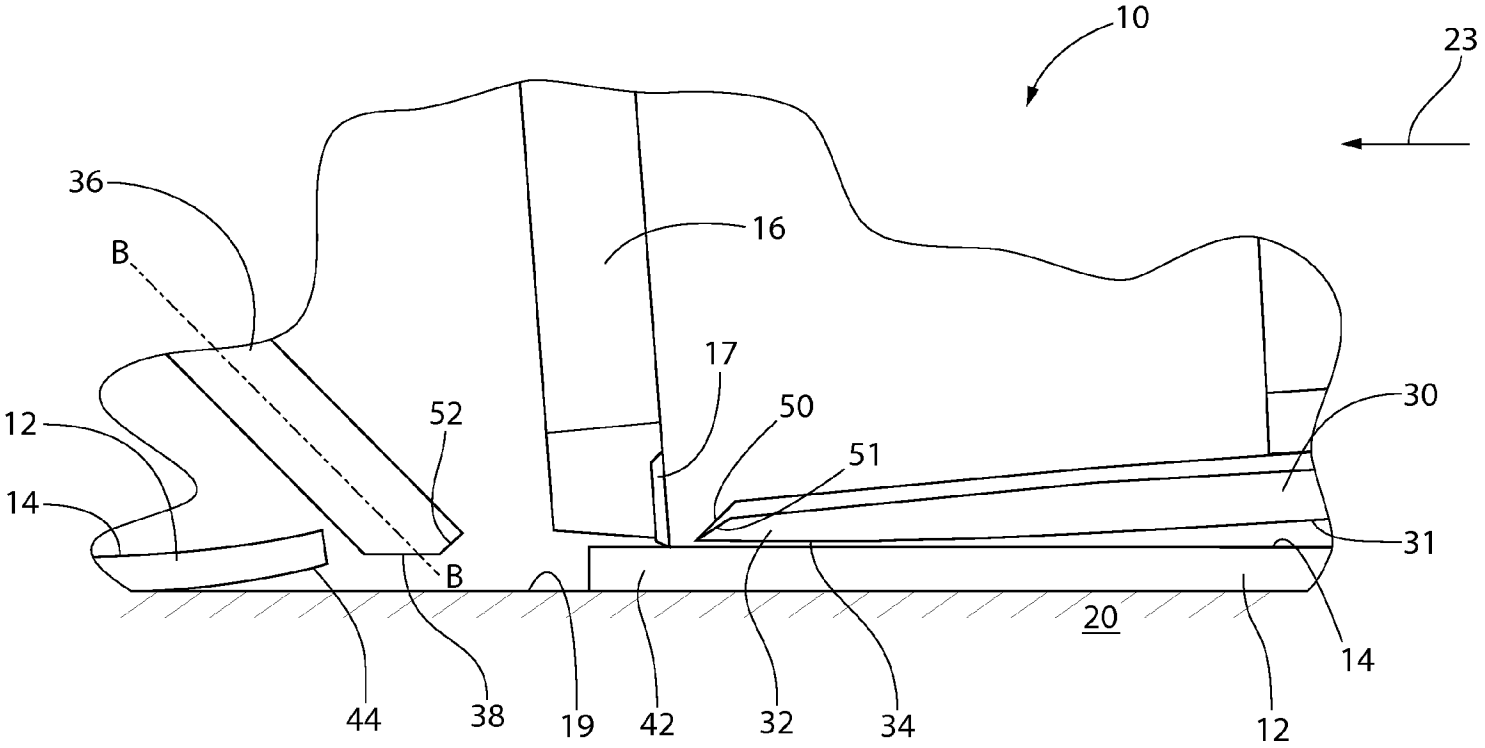
FIG. 4 is a schematic of the apparatus of FIG. 1 with several pieces of material positioned proximate the cutting head, a trailing edge of a first piece of material is shown prior to cooperating with the flattening device to properly position a trailing edge of the first piece of material relative to the cutting head, in this illustration the apparatus is moving in the same direction as the pieces of material.

The continued relative movement of the material 12 and/or apparatus 10 causes the leading edge 42 and the remaining portion of the material 12 to be moved under the surface 34, thereby insuring that the material 12 is properly positioned in the vertical direction prior to engagement with the cutting blade 17 (see, e.g. FIGS. 3, 3*a*, and 4). The surface 34 of the guide member 30 is machined or otherwise made flat (parallel to the material) so that no marks are made on the material surface as the material surface moves past the surface 34. The guide member 30 properly positions the material, thereby protecting the blade 17 and the cutter head 16 from damage. The proper positioning of the material 12 also prevents chatter.

The continued relative movement of the material 12 and/or apparatus 10 further causes the leading edge 42 and the remaining portion of the material 12 to be moved under the cutting blade 17 and under the bottom surface 38 of the flattening device 36. The surface 38 of the flattening device 36 is machined or otherwise made flat (parallel to the material) so that no marks are made on the material surface 14 as the material surface 14 moves past the surface 38. The engagement of the surface 38 with the material 12 prevents the material 12 from lifting from the support structure 20 even after the material surface 14 has been scraped.

When the apparatus 10 is retracted in the direction of arrow 23 (FIG. 4), the flattening device 36 is moved into proximity of a trailing edge 44 of the material 12. Continued movement of the apparatus 10 relative to the material 12 causes the trailing edge 44 to be moved under the guide member 30. If the trailing edge 44 is warped or lifted from the material support 20, as represented in FIG. 4, the angled flattening device 36 will act as a lead-in surface and will engage the trailing edge 44. Continued movement then causes the trailing edge 44 to move along the flattening device 36, causing the trailing edge 44 to be moved into or proximate to the material support 20, as shown in FIG. 6. The continued retraction or relative movement of the apparatus 10 causes the trailing edge 44 and the remaining portion of the material 12 to be moved under the surface 38, thereby insuring that the material 12 is properly positioned in the vertical direction, preventing the engagement of the cutting blade 17 as the apparatus 10 is retracted. The flattening device 36 also maintains the proper position of the material 12 relative to the blade 17, thereby protecting the blade 17 and the cutter head 16 from damage.

Figure 5:
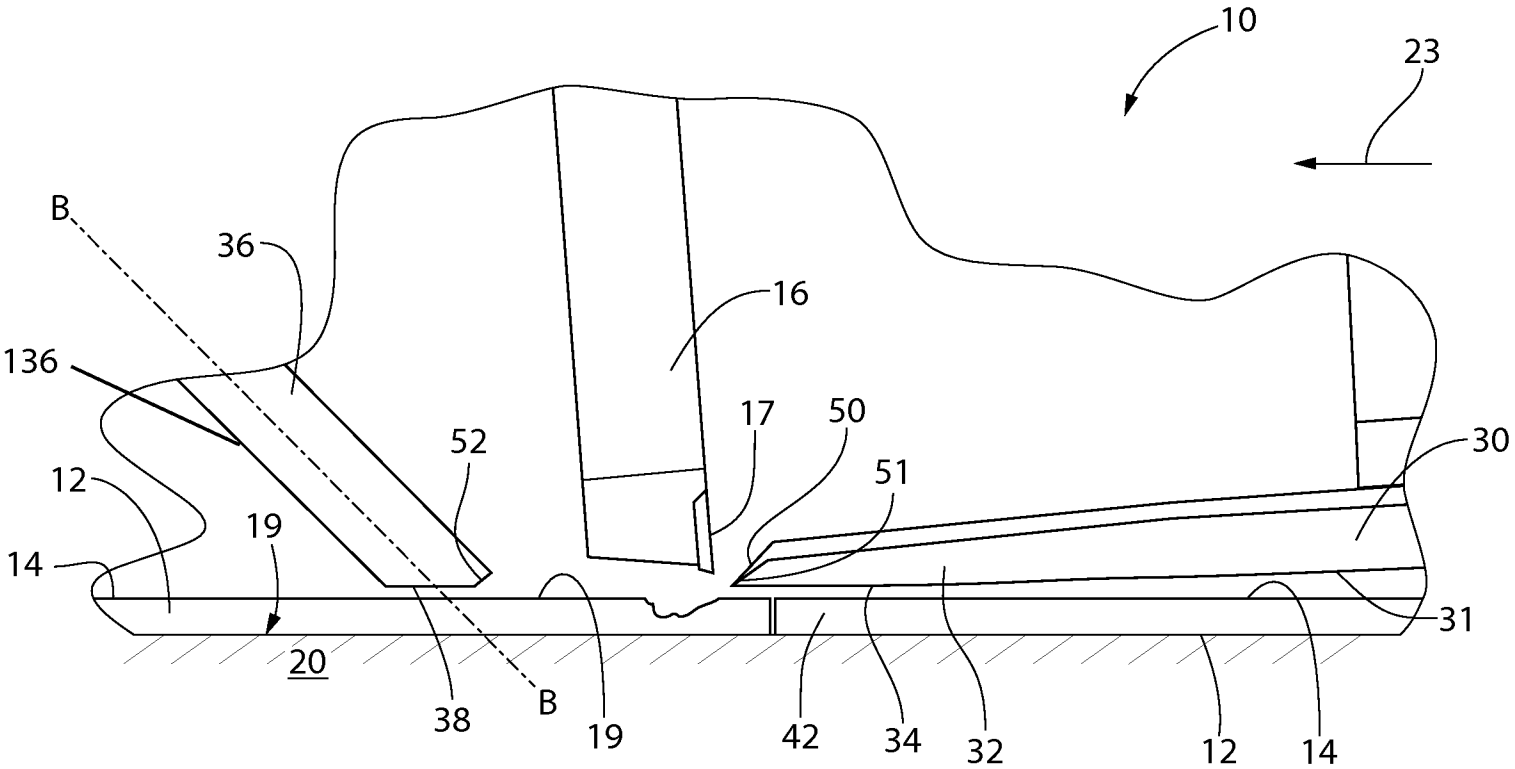
FIG. 5 is a schematic of the apparatus of FIG. 1 with several pieces of material positioned proximate the cutting head, a trailing edge of a first piece of material is shown with surface imperfections or distressing.

The use of the flattening device 36 and the proper positioning of the material also prevents chatter and/or gouging on the leading edge 42 of the material 12. Currently, chatter occurs when two boards (end to end) have a gap therebetween as shown in FIGS. 3 through 6. The gap may be, for example, of approximately 1" to 1.5" between boards. If no flattening device 36 is present, when the blade 17 and guide member 30 combination moves over the gap, downward pressure applied to the cutter head 16 by the cutter head support 11 would cause the blade 17 to fall slightly off the trailing end 44 of the of a respective piece of material. In such instances, as the material is advanced, the blade 17 comes into contact with the leading end 42 of the following or succeeding board; the force that is generated on impact is significant. The blade angle is also slightly different at the point of initial contact with the following board. The combination of force and angle cause the blade to jump as the apparatus moves in the cutting direction, resulting in excessive chatter or gouging. In addition to encountering potential gaps between boards, there may be discontinuities in the upper surface if the material, as shown in FIG. 5. If no flattening device 36 is present, when the blade 17 encounters the discontinuity, pressure applied to the cutter head 16 would cause the blade 17 to fall slightly off the trailing end 44 of the of a respective piece of material. The foregoing situations when not mitigated by the present invention may damage or break the tool 10, blade 17, and/or mar the top surface 14 of the workpiece material 12.

As the flattening device 36 and the guide member 30 are both attached to the apparatus 10, the flattening device 36 and the guide member 30 bridge the potential gaps between the material or irregularities or grooves on the surface of the material. As the scraping blade 17 disposed between the flattening device 36 and guide member 30 moves off the trailing end 44 of the lead board or material 12, the flattening device 36 remains in contact with the top surface 14 of that board or material 12. This supports the distal end 100 of the cutter head support 11 and prevents the blade 17 from falling down into a gap (see, e.g. FIG. 6). When the leading end 42 of the following or trailing succeeding board or material is contacted by the blade 17, the leveling effect the flattening device 36 has on the blade position thus minimizes the angular change to the initial contact point. This reduces chatter and gouging of the material 12. When the blade and apparatus are fully engaged on this following board or material, the flattening device 36 has cleared the top surface 14 of the lead board or material, as shown for example in FIG. 4. The guide member 30 now engaged with the top surface 14 of the following or succeeding board, however, supports and maintains the proper cutting position of the blade 17 for cutting or scraping this board (see also FIG. 4). Accordingly, the guide member 30 and flattening device 36 work in tandem for supporting and maintaining the proper cutting position of cutting blade 17 with respect to the lead and following board or material 12, as described above.

In summary, the method of distressing a board disclosed herein includes: supporting a first board 12 (e.g. lead board) on a support member 20; moving a first board relative to a cutter head 16 and/or moving the cutter head 16 relative to the first board; distressing the first board; engaging a surface 14 of the first board with a flattening device 36; supporting a second board (following or succeeding board) on the support member 20; moving a second board relative to the cutter head 16 and/or moving the cutter head 16 relative to the second board; and distressing the second board. The flattening device 36 remains in contact with the surface of the first board as the second board is moved proximate the cutter head 16, preventing the cutter head 16 from moving toward the support member 20 as the first board is moved from the cutter head 16 and the second board is moved toward the cutter head 16. During the cutting or scraping distressing operation, a downward force may be applied to cutter head 16 and the cutter head support 11 to in turn apply a downward force against the top surface 14 of workpiece material 12 by the blade 17.

In addition, the method may include: moving the first and second boards on the support member 20 and/or moving the apparatus 10 relative to the first and second boards into proximity of a guide member 30; engaging the guide member 30 with the leading edge 42 of either the first or second board; and guiding the leading edge 42 to be moved proximate the support member 20.

In addition, the method may include: retracting the cutter head 16 relative to the first board; engaging the trailing edge 44 of the first board with the flattening device 36; and guiding the trailing edge 44 to be moved proximate the support member 20.

In addition, the method may include: providing a gap between the first board relative to the second board; and engaging the first board with the flattening device 36 until the cutter head 16 engages the second board to maintain the cutter head 16 in proper vertical position with respect to the support member 20 as the cutter head is moved over the gap.

As described, the use of the flattening device 36 or the use of the flattening device 36 in combination with the guide member 30 advantageously prevents the issue of end lifted boards. Previously, there has been no mechanism for holding down end lifted boards as they are under the stroke of an apparatus or scraper head. Consequently, the end lifted boards were free to rise above the support surface, causing the end lifted boards to impact the backside (e.g. side 13) of the cutting blade (on the forward movement of the apparatus), causing the blade to crack or the blade fasteners to shear.

The use of the flattening device 36 also advantageously helps to maintain the proper vertical position of the cutter head 16 relative to the material, thereby preventing severe chatter with respect to the leading end of each board.

It is to be understood that in other embodiments, more than one cutting head may be used. In another embodiment, the cutting head may include more than one blade. In other embodiments, more than one cutter head support may be used. Accordingly, numerous variations of the apparatus described herein are possible.

Referring back to FIG. 1, the cutter head 16 (and the blade 17) is positioned between the guide member 30 and the flattening device 36. Specifically, the blade 17 is located within an elongated channel 800 that is formed between the guide member 30 and the flattening device 36. The channel 800 is open at both ends. In other words, the guide member 30 and the flattening device 36 do not circumscribe the blade 17.

While the invention has been described with reference to a preferred embodiment, it will be understood by those skilled in the art that various changes may be made and equivalents may be substituted for elements thereof without departing from the spirit and scope of the invention of the invention as defined in the accompanying claims. In particular, it will be clear to those skilled in the art that the present invention may be embodied in other specific forms, structures, arrangements, proportions, sizes, and with other elements, materials, and components, without departing from the spirit or essential characteristics thereof. One skilled in the art will appreciate that the invention may be used with many modifications of structure, arrangement, proportions, sizes, materials, and components and otherwise, used in the practice of the invention, which are particularly adapted to specific environments and operative requirements without departing from the principles of the present invention. The presently disclosed embodiments are therefore to be considered in all respects as illustrative and not restrictive, the scope of the invention being defined by the appended claims, and not limited to the foregoing description or embodiments.

What is claimed is:

1. An apparatus for distressing a surface of a material, the apparatus comprising:

a support configured for supporting a board of material;

a cutter head supporting a blade, the cutter head having a first side and a second side;

a guide member positioned proximate the first side of the cutter head, the guide member configured to engage the board;

a flattening device positioned proximate the second side of the cutter head, the flattening device being configured to engage the board, and comprising:

a bottom surface that is substantially parallel to a top surface of the support and compresses and flattens the board; and a chamfered lower surface that is at an acute angle relative to the top surface of the support, and that faces the blade; and the blade positioned between the guide member and the flattening device.

2. The apparatus as recited in claim 1, wherein the guide member is configured to compress and flatten the board when an edge of the board approaches the blade from the first side of the cutter head, and wherein the flattening device is configured to compress and flatten the board when an edge of the board approaches the blade from the second side of the cutter head.

3. The apparatus as recited in claim 2, wherein the flattening device extends along an axis that is at an acute angle with respect to the support.

4. The apparatus as recited in claim 1, wherein the flattening device comprises an angled section having a bottom surface disposed at an acute angle with respect to the top surface of the support to provide a lead-in surface for progressively engaging the board with the flattening device, the bottom surface of the angled section of the flattening device facing away from the cutting blade.

5. The apparatus as recited in claim 2, wherein the guide member comprises a bottom surface that is substantially parallel to a top surface of the support and compresses and flattens the board, wherein the flattening device comprises a bottom surface that is substantially parallel to the top surface of the support and compresses and flattens the board; and wherein the bottom surface of the guide member terminates in an apex adjacent the blade and the bottom surface of the flattening device terminates in an apex adjacent the blade, the apex of the guide member being located a third distance from the blade and the apex of the guide member being located a fourth distance from the blade, the fourth distance being greater than the third distance.

6. The apparatus as recited in claim 1, wherein the guide member includes an angled section having a bottom surface disposed at an acute angle with respect to a top surface of the support to provide a lead-in surface for progressively engaging the board with the guide member.

7. The apparatus as recited in claim 1, wherein the guide member comprises a bottom surface that is substantially parallel to a top surface of the support and compresses and flattens the board, the bottom surface of the guide member being vertically offset from a cutting edge of the blade a first distance, and; wherein the flattening device comprises a bottom surface that is substantially parallel to the top surface of the support and compresses and flattens the board, the bottom surface of the flattening device being is vertically offset from a cutting edge of the blade a second distance; and wherein the second distance is greater than the first distance.

8. The apparatus as recited in claim 1, wherein the guide member comprises a bottom surface that is substantially parallel to a top surface of the support and compresses and flattens the board; wherein the flattening device comprises a bottom surface that is substantially parallel to the top surface of the support and compresses and flattens the board; and wherein the bottom surfaces of the guide member and the flattening device are non-coplanar.

9. The apparatus as recited in claim 1, further comprising an adjustment mechanism configured to adjust the vertical position of the flattening device with respect to the support.

10. The apparatus as recited in claim 1, wherein the material is a wood board.

11. An apparatus for distressing a surface of a material, the apparatus comprising:

a material support configured for supporting a board of material;

a cutter head support positioned above the material support;

a cutter head mounted to the cutter head support, the cutter head supporting a blade for distressing the board, the cutter head having a first side and a second side;

a guide member mounted to the cutter head support, the guide member positioned proximate the first side of the cutter head, the guide member configured to engage the board; and a flattening device mounted to the cutter head support, wherein the flattening device is positioned proximate the second side of the cutter head, and is configured to engage the board, and wherein the flattening device comprises an angled section having a bottom surface disposed at an acute angle with respect to the to surface of the support to provide a lead-in surface for progressively engaging the board with the flattening device, the bottom surface of the angled section of the flattening device facing away from the cutting blade.

12. The apparatus as recited in claim 11, wherein the flattening device is elongated and disposed at an oblique angle with respect to the material support.

13. The apparatus as recited in claim 11, wherein the cutter support extends above the material support in a cantilevered manner.

14. The apparatus as recited in claim 11, wherein a bottom surface of the flattening device that engages the board is substantially parallel to a top surface of the material support.

15. The apparatus as recited in claim 11, wherein the guide member includes an angled section having a bottom surface disposed at an acute angle with respect to a top surface of the material support to provide a lead-in surface for progressively engaging the board with the guide member, the bottom surface of the angled section of the guide member facing away from the cutting blade.

16. The apparatus as recited in claim 15, wherein the guide member comprises a bottom surface that is substantially parallel to a top surface of the support and compresses and flattens the board; wherein the flattening device comprises a bottom surface that is substantially parallel to the top surface of the support and compresses and flattens the board; and wherein the bottom surfaces of the guide member and the flattening device are non-coplanar.

17. The apparatus as recited in claim 11, further comprising an adjustment mechanism configured to adjust the vertical position of the flattening device with respect to the material support.

18. The apparatus as recited in claim 11, wherein the material is a wood board.

19. A method of distressing a board, the method comprising:

supporting a first board on a support;

moving the first board relative to a cutter head;

engaging a top surface of the first board with a guide member;

distressing the first board using the cutter head;

engaging the top surface of the first board with a flattening device, wherein the flattening device comprises:

a bottom surface that is substantially parallel to a top surface of the support and compresses and flattens the first board; and a chamfered lower surface that is at an acute angle relative to the top surface of the support, and that faces the cutter head;

supporting a second board on the support;

moving the second board relative to the cutter head;

distressing the second board;

maintaining engagement of the top surface of the first board with the flattening device as the second board is moved proximate the cutter head; and preventing the cutter head from moving toward the support as the first board is moved from the cutter head and the second board is moved toward the cutter head.

20. The method as recited in claim 19, further comprising:

engaging the guide member with a leading edge of either the first or second board before distressing the first or second board.

21. The method as recited in claim 19 further comprising:

moving a trailing edge of the first board past the cutter head;

engaging the trailing edge of the first board with the flattening device;

maintaining engagement of the trailing edge of the first board with the support with the flattening device.

22. The method as recited in claim 19 further comprising:

moving the first board relative to the second board such that a gap is provided between the first board and the second board;

engaging the first board with the flattening device until the cutter head engages the second board to maintain the cutter head in proper vertical position with respect to the support as the cutter head is moved over the gap.

* * * * *